US007913871B2

(12) United States Patent
Fisher

(10) Patent No.: US 7,913,871 B2
(45) Date of Patent: Mar. 29, 2011

(54) GARBAGE CAN AND SUPPORT FOR USE WITH A LINER

(76) Inventor: Jack D. Fisher, Glendale, AZ (US)

( * ) Notice: Subject to any disclaimer, the term of this patent is extended or adjusted under 35 U.S.C. 154(b) by 512 days.

(21) Appl. No.: 11/835,293

(22) Filed: Aug. 7, 2007

(65) Prior Publication Data

US 2008/0023480 A1 Jan. 31, 2008

Related U.S. Application Data

(63) Continuation-in-part of application No. 11/318,730, filed on Dec. 27, 2005, now abandoned.

(51) Int. Cl.
*B65D 25/14* (2006.01)
*B65D 35/14* (2006.01)
*B65D 8/04* (2006.01)

(52) U.S. Cl. ..... 220/495.06; 220/495.11; 220/625; 220/908.1

(58) Field of Classification Search ..... 220/495.06, 220/495.08, 495.11, 610, 611, 625, 908.1
See application file for complete search history.

(56) References Cited

U.S. PATENT DOCUMENTS

| | | | | |
|---|---|---|---|---|
| 1,879,410 | A | 9/1932 | Morris et al. | |
| 3,915,329 | A | 10/1975 | Zaks | 220/65 |
| 3,997,072 | A | 12/1976 | Guth | 220/1 |
| 4,014,157 | A | 3/1977 | Pearce | 53/35 |
| 4,027,774 | A | 6/1977 | Cote | 220/63 |
| 4,167,271 | A | 9/1979 | Jorgensen | 280/79.1 |
| 4,222,580 | A | 9/1980 | Krokonko | 280/47.34 |
| 4,254,602 | A | 3/1981 | Boynton | 53/390 |
| 4,279,357 | A * | 7/1981 | Robinson | 220/318 |
| 4,294,379 | A | 10/1981 | Bard | 220/404 |
| 4,440,321 | A | 4/1984 | Campbell et al. | 222/153 |
| 4,457,483 | A | 7/1984 | Gagne | 248/97 |
| 4,643,380 | A | 2/1987 | Copeland | 248/97 |
| 4,842,228 | A | 6/1989 | Kasper | 248/97 |
| 5,123,562 | A | 6/1992 | Bullard et al. | 220/334 |
| 5,226,554 | A | 7/1993 | Dauphinais | 220/402 |
| 5,228,591 | A | 7/1993 | Jones | 220/528 |
| 5,295,606 | A | 3/1994 | Karwoski | 220/403 |
| 5,375,732 | A | 12/1994 | Bowers et al. | 220/404 |
| 5,419,453 | A | 5/1995 | Lochridge | 220/404 |
| 5,645,186 | A | 7/1997 | Powers et al. | 220/404 |
| 5,716,033 | A | 2/1998 | Gibson | 248/95 |
| 5,862,932 | A | 1/1999 | Walsh et al. | 220/8 |
| 5,884,556 | A | 3/1999 | Klepacki et al. | 100/53 |
| 5,950,251 | A * | 9/1999 | Cost et al. | 4/483 |
| 6,015,063 | A | 1/2000 | Poliquin | 220/495.04 |
| 6,109,002 | A | 8/2000 | McCabe | 53/390 |
| 6,142,325 | A | 11/2000 | Chomik | 215/343 |
| 6,253,949 | B1 | 7/2001 | Dickson | 220/495.04 |
| 6,296,138 | B1 | 10/2001 | Hannah et al. | 220/495.08 |

(Continued)

*Primary Examiner* — Anthony Stashick
*Assistant Examiner* — Harry A Grosso
(74) *Attorney, Agent, or Firm* — Kunzler Needham Massey & Thorpe

(57) ABSTRACT

An apparatus and method for releasably supporting a liner, such as a trash bag or laundry bag, within a container, such as a trash can or laundry basket. The apparatus includes a body and a base. The base includes a top opening and a bottom opening, with the area of the top opening being less than the area of the bottom opening. The base is releaseably attachable to the body using a compliant latch. Additionally, the body gradually slopes inward from the bottom opening to the top opening. The body is configured to receive a liner, which removably fits inside the body to protect the body from direct contact with soiled objects.

21 Claims, 18 Drawing Sheets

U.S. PATENT DOCUMENTS

| | | | | |
|---|---|---|---|---|
| 6,474,495 | B1 | 11/2002 | Frei | 220/495.08 |
| 6,594,876 | B1 | 7/2003 | Stastny | 29/401.1 |
| 6,612,099 | B2 | 9/2003 | Stravitz | 53/526 |
| 6,715,980 | B2 | 4/2004 | Bouthillier | 414/642 |
| 7,500,430 | B2 * | 3/2009 | Claflin et al. | 100/90 |
| 2003/0209549 | A1 | 11/2003 | Grimes | 220/495.08 |
| 2004/0065666 | A1 | 4/2004 | Walker | 220/315 |
| 2006/0056741 | A1 * | 3/2006 | Yang et al. | 383/33 |

* cited by examiner

GARBAGE CAN AND SUPPORT FOR USE WITH A LINER

CROSS-REFERENCES TO RELATED APPLICATIONS

This application is a continuation-in-part of and claims priority to U.S. patent application Ser. No. 11/318,730 entitled "GARBAGE CAN AND SUPPORT FOR USE WITH A LINER" and filed on Dec. 27, 2005 now abandoned for Jack Donald Fisher, which is incorporated herein by reference.

BACKGROUND OF THE INVENTION

1. Field of the Invention

This invention relates to storage containers. More particularly, the invention relates to containers that are versatile and facilitate filling and removing a liner.

2. Description of the Related Art

When utilizing a garbage can to support a plastic garbage bag having a peripheral end portion folded over the top edge of the can, the bag generally adheres to the sidewall of the can even when it is only partially loaded. It is thus often difficult to withdraw the bag due to the adherence thereof to the can sidewall as well as to the vacuum which is created between the bottom of the bag and that of the can when the bag is pulled out of the can. On the other hand, one can hardly do without a garbage can or the like to support a garbage bag, since the bag itself has no body as such and is therefore not self-supporting, and without external support the bag can be loaded only with great difficulty.

Moreover, when using plastic garbage bags, care must be taken during the loading in order to prevent sharp objects, such as scrap pieces of wood, small rocks, and the like, from piercing the bags. In addition, the presence of sharp objects typically does not permit the garbage to be compressed inside the bag since otherwise the latter would pierce, thus resulting in one not being able to load the bag to its full capacity. The same also applies to indoor use as household rubbish generally includes sharp items such as pizza boxes, broken glass, open cans, and the like.

Many garbage cans have attempted to overcome the deficiencies above by providing garbage cans that incorporate air tubes and/or air holes to decrease the amount of vacuum created when one pulls the trash bag from the garbage can. Others have created collapsible garbage cans that unwrap from the garbage bag. These garbage cans, however, suffer from additional deficiencies.

First, holes formed into the garbage can decrease the garbage can strength and liquids and smells may begin to seep there from. Secondly, collapsible garbage cans generally lack the structural integrity to adequately hold trash bags at full capacity as the collapsible garbage cans may unintentionally unwrap. Bag support devices have also been used to protect garbage bags from punctures. The bag support devices have been described as taller than the garbage bags, and use awkward, elongated handles. Because the garbage bag is pulled over the entire length of the bag support device, the garbage bag is still left unprotected from external hazards, such as bushes, shrubs, thorns, etc.

From the foregoing discussion, it should be apparent that a need exists for an apparatus and method that supports a liner and facilitates the removal and protection of the liner. The apparatus and method would enable the user to remove the liner from the container without causing suction and without puncturing the liner. Additionally, the apparatus would be easier to clean, have a greater capacity, and would capture spills.

SUMMARY OF THE INVENTION

The present invention has been developed in response to the present state of the art, and in particular, in response to the problems and needs in the art that have not yet been fully solved by currently available liner supports. Accordingly, the present invention has been developed to provide an apparatus and method for releasably providing liner support that overcome many or all of the above-discussed shortcomings in the art.

The apparatus, in one embodiment, is configured to releasably support a liner and includes a body and a base. The body is configured to receive the liner, which includes an outer surface, an inner surface, and a bottom and may be longer in length than the body. The body includes a top opening and a bottom opening, with the area of the top opening being less than the area of the bottom opening, which advantageously enhances the stability of the apparatus.

The base comprises an inner surface configured to provide support to a bottom of the liner. The base is releasably attachable to the body at the bottom opening of the body using a compliant latch, the compliant latch disposed on one of the base and the body and configured to interlock with a retention flange, the retention flange disposed on another of the base and the body. Further, because the top opening is smaller than the bottom opening, advantageously, material spilled on the outside surface of the apparatus will be more likely to rest in the base, instead of on the floor around the apparatus. For example, a liquid would flow down the exterior surface of the apparatus to the base instead of dripping on the floor.

Additionally, in certain embodiments, the body gradually slopes inward from the bottom opening to the top opening. Advantageously, the slope of the body may provide for easy removal of the liner, wherein separation of the apparatus from the liner does not involve significant vacuum forces as in conventional trash cans and liners.

In one embodiment, the liner removably fits inside the body to protect the body from direct contact with soiled objects. This advantageously allows one to fit considerably more material inside the apparatus by compressing the material with forces which may otherwise damage the liner. This adds a further advantage wherein fewer liners are needed for the same amount of material. The liner is longer in length than the body to allow the liner to wrap around the top opening of the body. The base releasably attaches to the body at the bottom opening, which advantageously makes the apparatus easier to clean, avoiding odors, germs, and pests, an advantage especially important for uses such as in hospitals. The inner surface of the base supports the bottom of the liner.

In one embodiment, the apparatus is configured to store trash. The body may be any shape or size, and may include a lid. Clips may be used to attach the liner to the body.

The apparatus, in another embodiment, is advantageously configured to protect the liner from puncture. Specifically, the body protects the liner from puncture when the bottom opening is inserted into the liner first. The base attaches to the body, thus trapping the liner between the base and a lower lip of the body. Securing devices hold the liner in a generally fixed zone about the body to prevent the liner from snagging twigs, limbs, etc. Additionally, the handles remain uncovered to allow easy movement of the apparatus.

The handles may be notched to retain the liner. The notch may take any suitable shape, and in one embodiment, the notch is v-shaped.

Additionally, the apparatus may be reversible. That is, the body may be provided with a latchable base and a latchable lid so that the base may be positioned either with the small opening facing up or with the large opening facing up, A method of the present invention is also presented for providing support to the liner. In one embodiment, the method includes providing a body with a top opening having less area than a bottom opening, the body gradually sloping from the bottom opening to the top opening, inserting the bottom opening into an opening of the garbage bag, gathering the opening of the garbage bag and sides of the garbage bag about the bottom opening of the body, attaching a base to the bottom opening with a securing device, securing the garbage bag and sides of the garbage bag to a lower portion of the body, filling the body with objects, when filled, removing the base and letting contents drop into the liner, and removing the body from the liner.

The method may also include the step of securing the garbage bag sides to the lower portion of the body with the same securing device that is used to attach the base to the body.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1A:
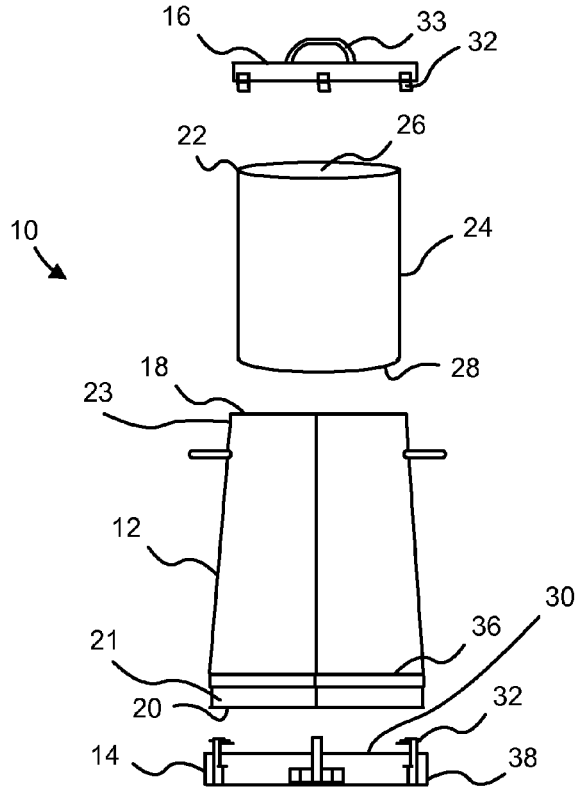
FIGS. 1A-1C illustrate an exploded, front, and perspective view respectively of an apparatus for supporting a liner according to one embodiment of the present invention.
Figure 1B:
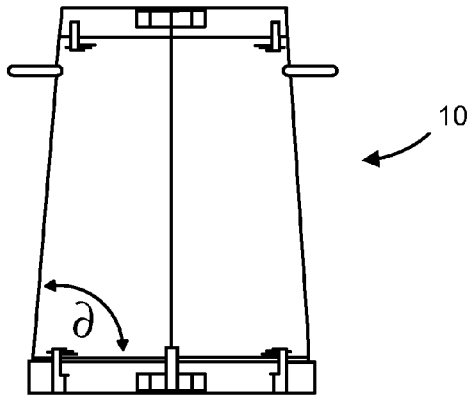
Figure 1C:
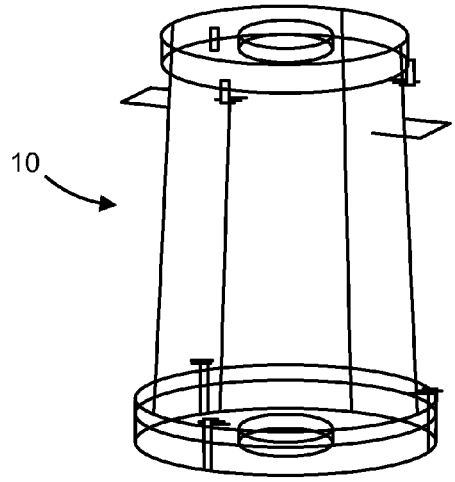

FIGS. 1A-1C depict an apparatus 10 for supporting a liner 22, such as a trash bag, a laundry bag, or the like. The apparatus 10 may be used to store any kind of object or material such as trash, laundry, leaves, rocks, dirt, branches, etc. Accordingly, the apparatus 10 may be a trash can, a laundry basket, a storage bin, or other type of container in certain embodiments. For explanation purposes, and not to be taken as limiting in its application, the apparatus 10 will be described as a trash can 10 for storing trash, generally, trash commonly removed from a home or yard.

In one embodiment, the trash can 10 comprises a body 12, a base 14, and a cover, or lid 16. The body 12 includes a top opening 18 and a bottom opening 20. In one embodiment, the area of the top opening 18 is less than the area of the bottom opening 20. In the depicted embodiment, the body 12 gradually slopes inward from the bottom opening 20 to the top opening 18 to create a funnel, or conical-shaped body 12. Of course, the body 12 may have other shapes as well.

In certain embodiments, a bottom lip 21 may run perpendicular to the base 14 to allow the base 14 to easily fit over the bottom lip 21. Similarly, a top lip 23 may run perpendicular to the lid 16 to allow the lid 16 to easily fit over the top lip 23.

The body 12 may slope or otherwise progress inward from the bottom opening 20 to the top opening 18. In one embodiment, the body 12 slopes inward from the bottom opening at more than 90 degrees with respect to a horizontal axis of the base 14, as illustrated in FIG. 1B by angle $\alpha$. In a further contemplated embodiment, the body 12 slopes inward at an angle $\alpha$ that is approximately 110 degrees.

The body 12 may be configured to receive a liner 22. The liner 22 includes an outer surface 24, an inner surface 26, and a bottom 28. The liner 22, in certain embodiments, removably fits inside the body 12 to protect the body 12 from direct contact with soiled objects. To enable the liner 22 to fold over the body 12, the body 12 may be shorter in length than the length of the liner 22. In one embodiment, a liner securing device, such as a series of clips (not shown), attached to an outer surface of the body 12, releasably secure upper edges of the liner 22 to the body 12. In operation, a user pulls the liner 22 between the clips and the body 12 to hold the liner 22 thereto. One skilled in the art will recognize that there are numerous methods and devices for securing the liner 22 to the body 12.

The base 14 releasably attaches to the body 12 at the bottom opening 20. In done embodiment, securing devices 32 secure the base 14 to the body 12. In the illustrated embodiment, the securing devices 32 extend perpendicular to the base 14 a predetermined distance and are designed to flex over the bottom lip 21 of the body 12 and enter slots 36 to hold the base 14 to the body 12. It is recognized, however, that the securing devices 32 may be incorporated directly into side walls 38 of the base 14, rather than extending perpendicular therefrom. When the base 14 is attached to the body 12, an inner surface 30 of the base 12 supports the bottom 28 of the liner 22 to prevent the liner 22 from ripping when loaded.

In one embodiment, the base 14 comprises at least one foot rest (not shown) protruding outward from the base 14 to allow the user to stand on the foot rest while the user lifts the body 12 therefrom. Advantageously, the user is not required to bend down and release the base 14 from the body 12.

The lid 16 is designed to removably attach to the body 12 to maintain the objects within the trash can 10 and prevent odors from escaping therefrom. The lid 16 may include a handle 33 to facilitate removal of the lid 16, and the lid 16 may be secured to the body 12 with one or more securing devices 32.

Because the lid 16 and the base 14 may be secured to the body 12, the trash can 10 is, in one embodiment, reversible. That is, the trash can 10 may be used alternatively with either the top opening 18 or the bottom opening 20 facing up to receive objects for storage within the trash can 10. In this embodiment, handles may be formed in the lid 16 or the base 14 in a recessed manner such that the trash can 10 may stand flat on either the lid 16 or the base 14.

Figure 2A:
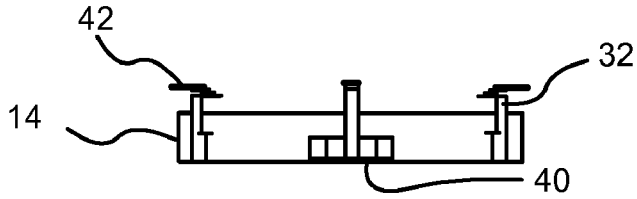
FIGS. 2A-2E illustrate side views of bases according to various embodiments of the present invention.
Figure 2B:
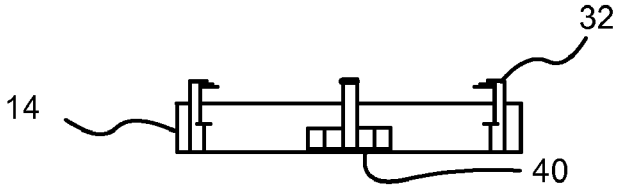

FIGS. 2A-2E illustrate the base 14 having various embodiments of securing devices 32. The securing devices 32 may also be used to fasten the lid 16 to the body 12. Each base 14 may include a handle 40. Referring to FIGS. 2A-2B, as described above with respect to FIG. 1, the securing devices 32 extend perpendicular to the base 14 a predetermined distance. The securing devices 32, of this embodiment, are designed to flex over the bottom lip 21 (See FIG. 1) of the body 12, slide over the bottom lip 21, and enter slots 36 (See FIG. 1) to hold the base 14 to the body 12.

The securing devices 32 of FIG. 2A include foot latches 42, which allow the user to step on top of the foot latch 42 to release the securing device from the slots 36. Additionally, the securing devices 32 may be hingedly, pivotably, or rotatably attached to the base 14 to allow the user to disengage the securing devices 32 from the body 12 and move the securing devices 32 away from the body 12 to facilitate the removal of the base 14 from the body 12.

Figure 2C:
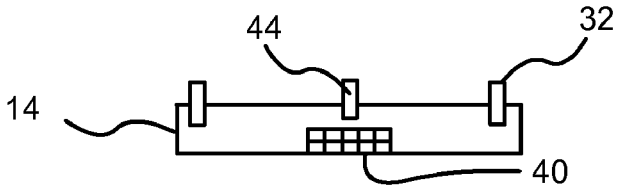

Referring to FIG. 2C, the securing device 32 may be a buckle type device configured to latch onto the body 12. Specifically, hoops 44 rotatably connect to the base 14 and attach to posts (not shown) on the body 12. The hoops 44 may be tightened using well known buckle techniques.

Figure 2D:
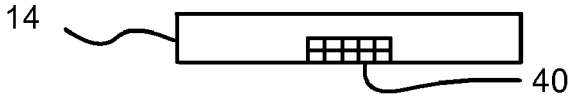

Referring to FIG. 2D, the base 14 is shown configured to form a tight friction fit with the body 12. The body 12 fits into the base 14 and friction prevents the body 12 and the base 14 from separating until the user applies a force strong enough to detach the base 14 from the body 12.

Figure 2E:
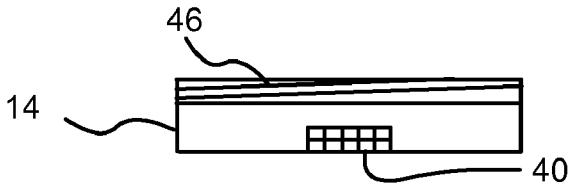
Figure 3A:
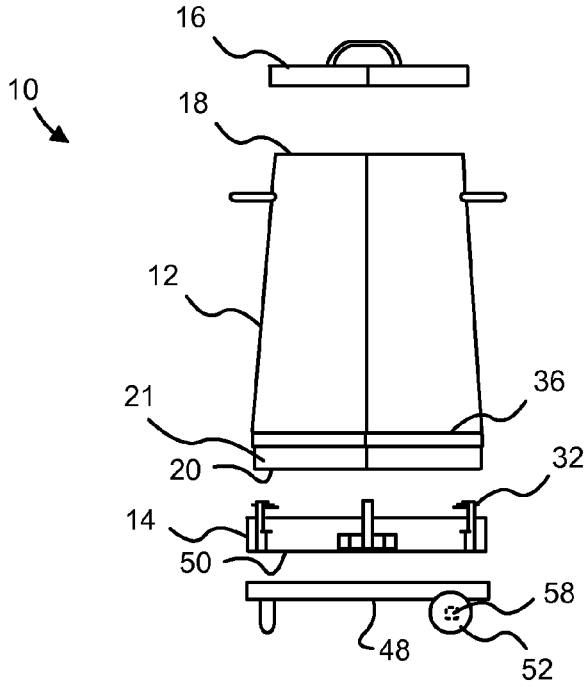
FIGS. 3A-3C illustrate an exploded, front, and perspective view of respectively an apparatus for supporting a liner with a wheel assembly according to one embodiment of the present invention.
Figure 3B:
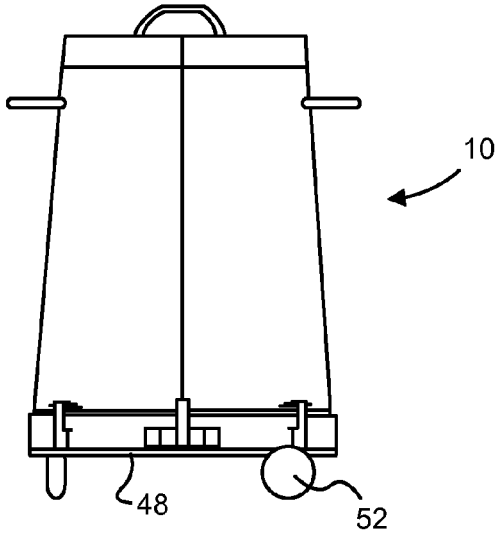
Figure 3C:
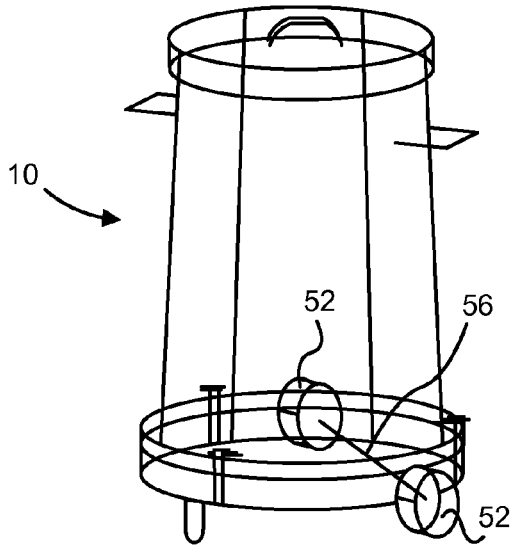

Referring to FIG. 2E, the base 14 is shown including threads 46 to screw onto the body 12. The threads 46 may be internal or external, depending on the corresponding threads on the body 12.

FIGS. 3A-4C illustrate trash cans 10 having an optional wheel assembly to facilitate movement thereof according to various embodiments of the present invention. Specifically referring to FIGS. 3A-3C, a wheel base 48 removably attaches to a bottom 50 of the base 14. The wheel base 48 may be permanently attached, or may be attached using any suitable mechanism, including the mechanisms described above in certain embodiments. The wheel base 48, in the illustrated embodiment, includes a post and a pair of wheels 52 connected together via a single axel 56. The axel 56 connects to the wheel base 48 through a pair of axel blocks 58.

Figure 4A:
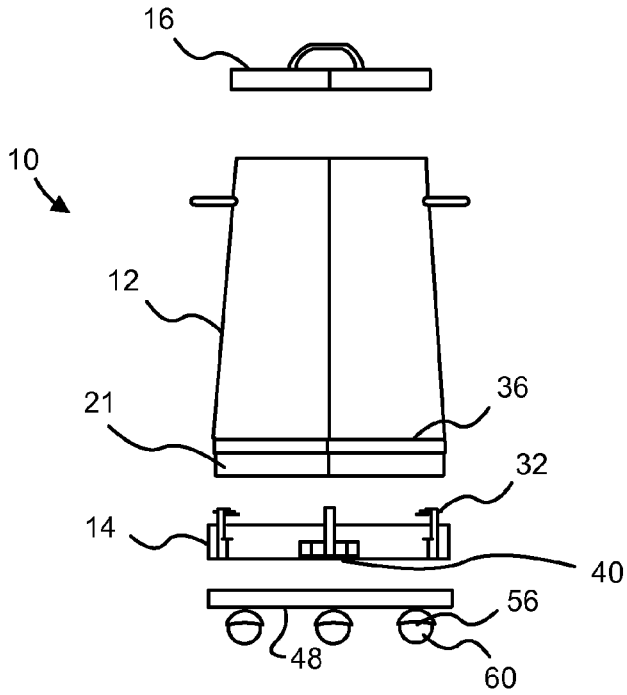
FIGS. 4A-4C illustrate an exploded, front, and perspective view respectively of an apparatus for supporting a liner with a wheel assembly according to another embodiment of the present invention.
Figure 4B:
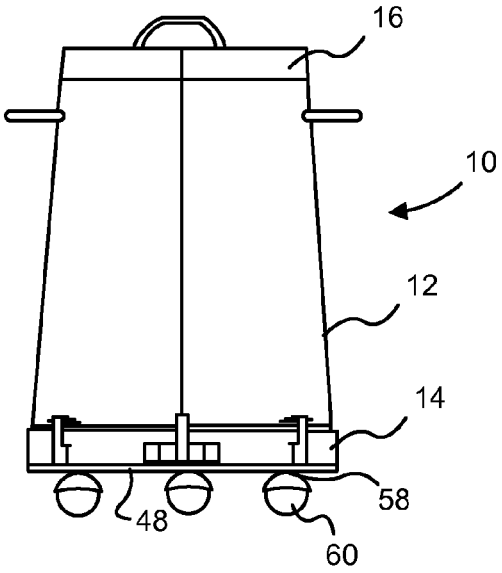
Figure 4C:
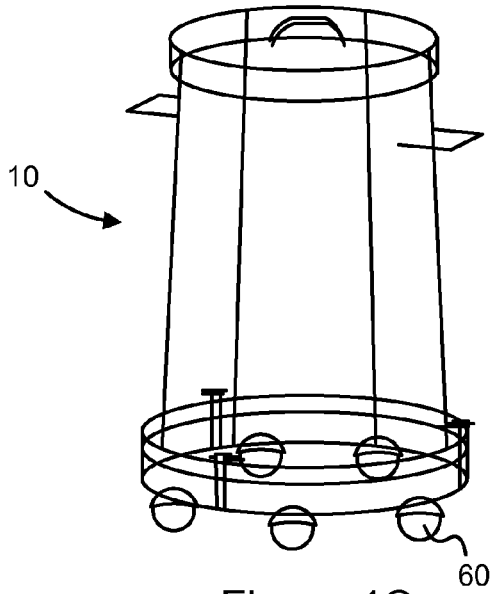

The wheel base 48 of FIGS. 4A-4C comprises a plurality of swivel wheels 60 or casters. The swivel wheels 60 connect to the wheel base 48 with well known attachment devices. One skilled in the art will recognize that there are various wheel configurations available.

Figure 5A:
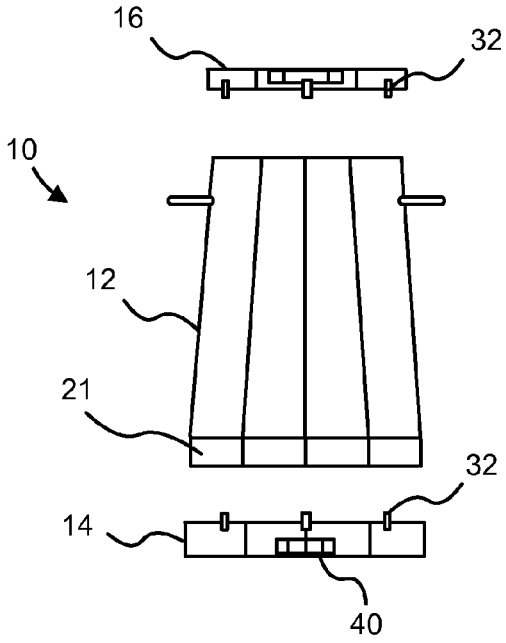
FIGS. 5A-5C illustrate an exploded, front, and perspective view respectively of an apparatus for supporting a liner having an octagonal shape according to one embodiment of the present invention.
Figure 5B:
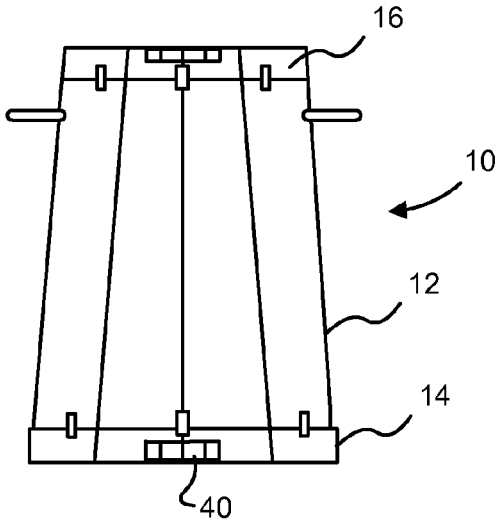
Figure 5C:
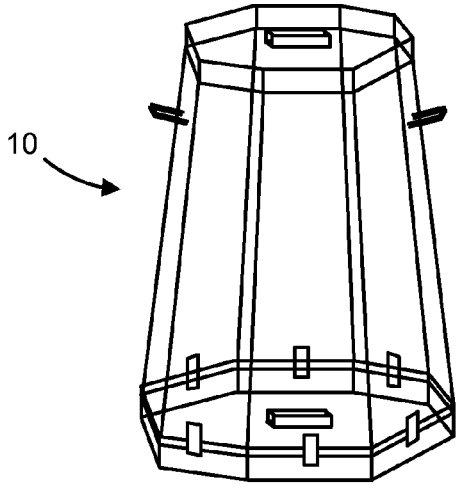

FIGS. 5A-6C illustrate alternative embodiments of the trash can 10. Specifically, FIGS. 5A-5C show the trash can 10 having an octagonal-shaped body 12, base 16, and corresponding lid 16.

Figure 6A:
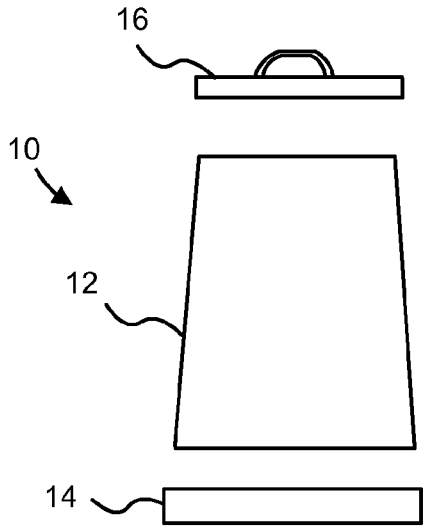
FIGS. 6A-6C illustrate an exploded, front, and perspective view respectively of a rectangular shaped apparatus for supporting a liner according to one embodiment of the present invention.
Figure 6B:
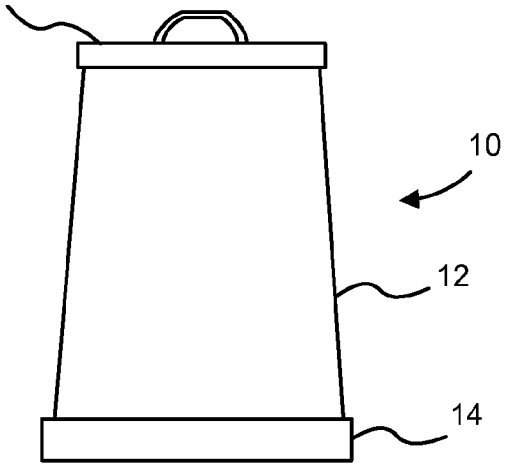
Figure 6C:
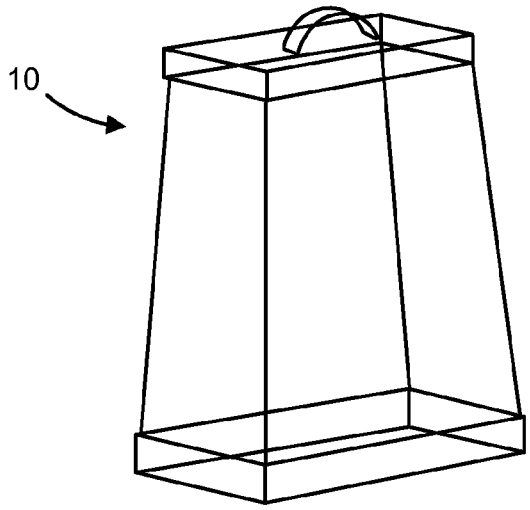
Figure 15:
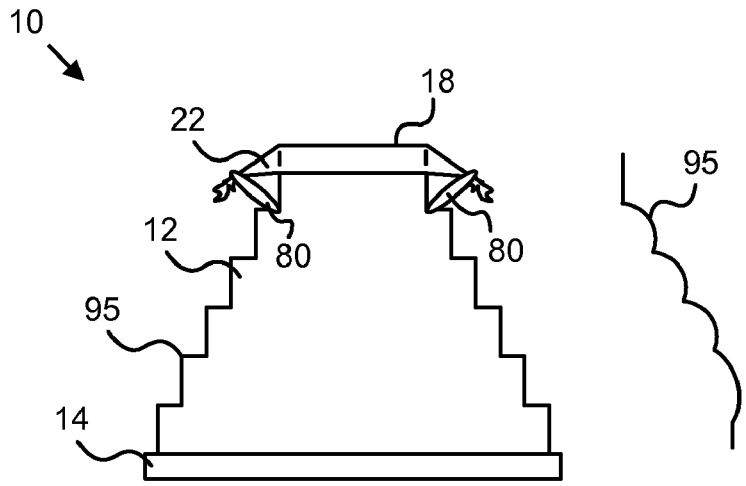
FIG. 15 is a side view illustrating an apparatus for supporting a liner having a body with a stepped exterior according to one embodiment of the present invention.
Figure 16:
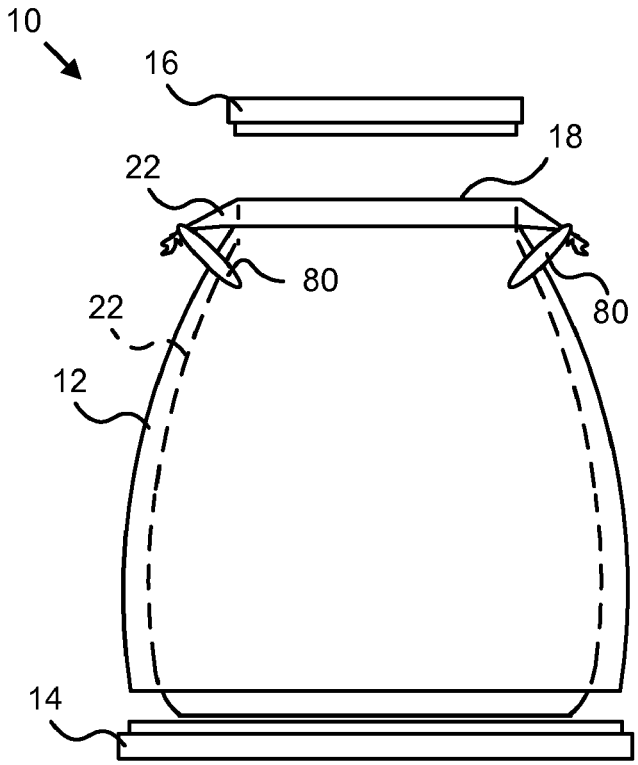
FIG. 16 is an exploded side view illustrating an apparatus for supporting a liner having a body with a rounded exterior according to one embodiment of the present invention.

FIGS. 6A-6C show the trash can 10 having a rectangular shape. One skilled in the art will recognize that the illustrated embodiments are not intended to be limiting. Rather one skilled in the art will recognize that there are innumerable shapes and sizes of trash cans 10 that can be used. FIGS. 15 and 16 illustrate further suitable shapes.

Figure 7A:
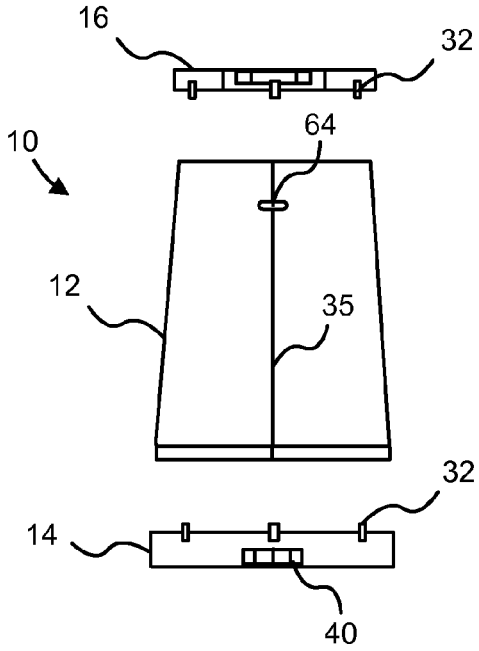
FIGS. 7A-7C illustrate an exploded, front, and perspective view respectively of an apparatus for supporting a liner that opens from a side to expose the liner according to one embodiment of the present invention.
Figure 7B:
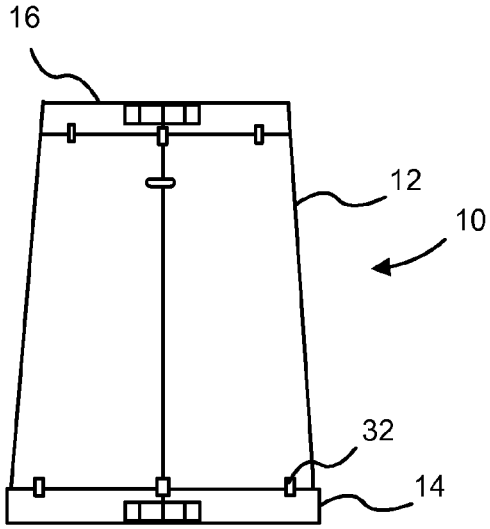
Figure 7C:
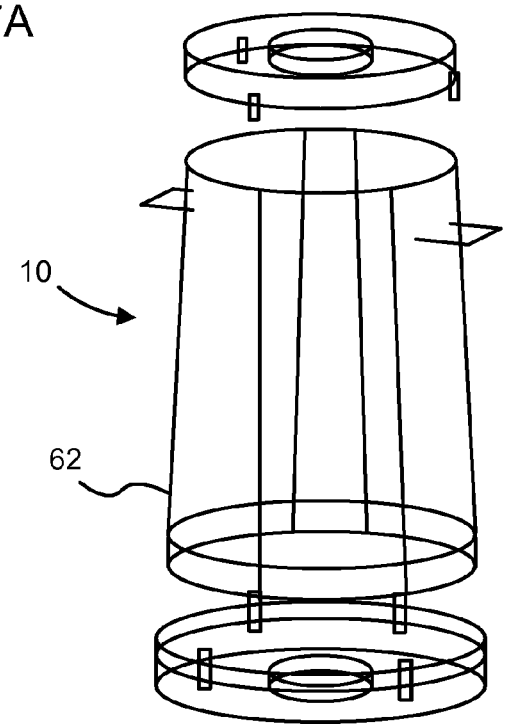

FIGS. 7A-8C illustrate an apparatus 10 for supporting a liner that facilitates removal of the liner 22 with a releasable seam 35 in the side of the body 12. Specifically, FIGS. 7A-7C show the body 12 configured to open on a side 62 to expose the inner side of the body 12. A securing device 64 may be used to hold the body 12 closed. The body 12, may comprise a flexible material to allow the user to spread the sides 62 of the body 12 open. Alternatively, the body 12 may comprise multiple side members connected by a connecting device such as a hinge, rail assembly, or the like.

Figure 8A:
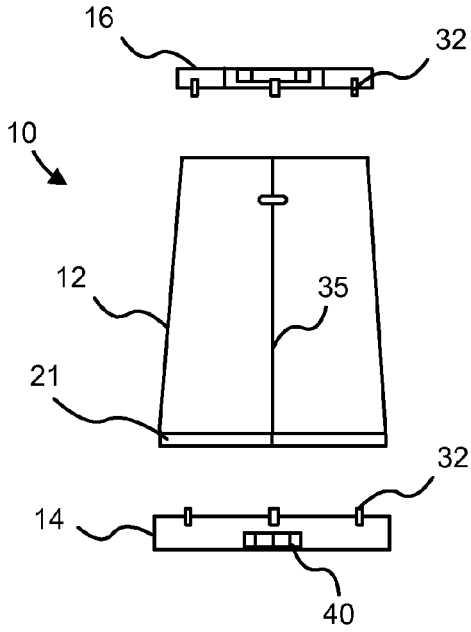
FIGS. 8A-8C illustrate an exploded, front, and perspective view respectively of an apparatus for supporting a liner that splits in half to expose the liner according to one embodiment of the present invention.
Figure 8B:
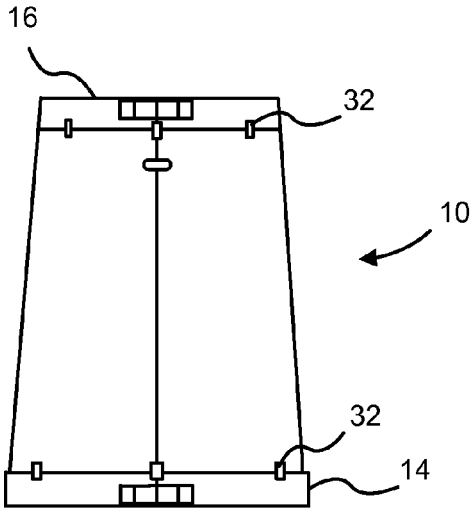
Figure 8C:
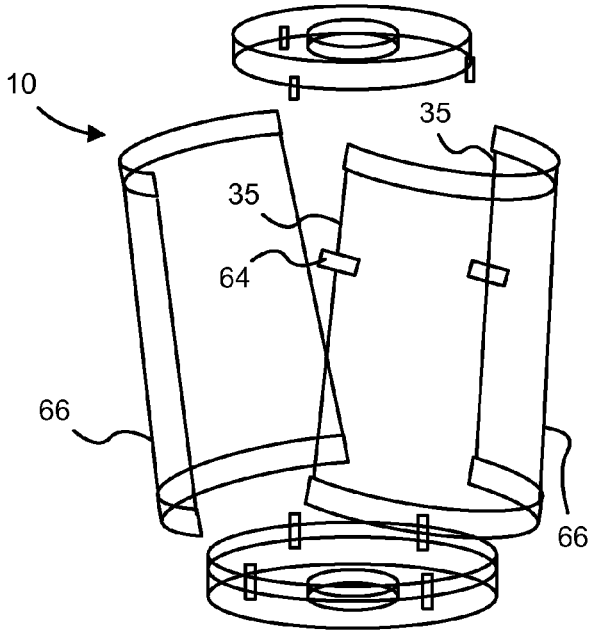

Referring to FIGS. 8A-8C, the body 12 may be configured with two seams 35 such that the body 12 may be split into two corresponding side members 66 to reveal the contents of the body 12. In certain embodiments, the side members 66 hingedly connect to the base 14.

Figure 9A:
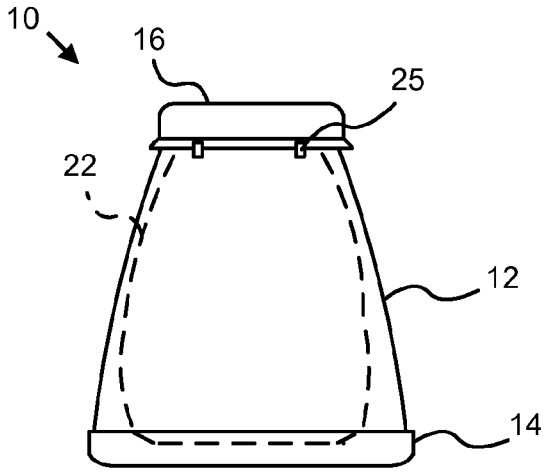
FIGS. 9A-9C illustrate a method of removing a body of the apparatus from a filled liner according to one embodiment of the present invention.
Figure 9B:
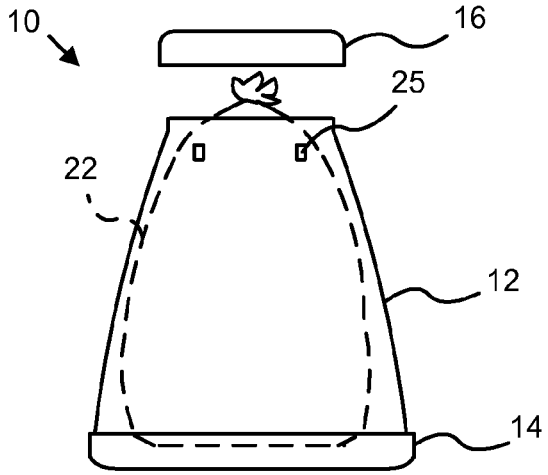
Figure 9C:
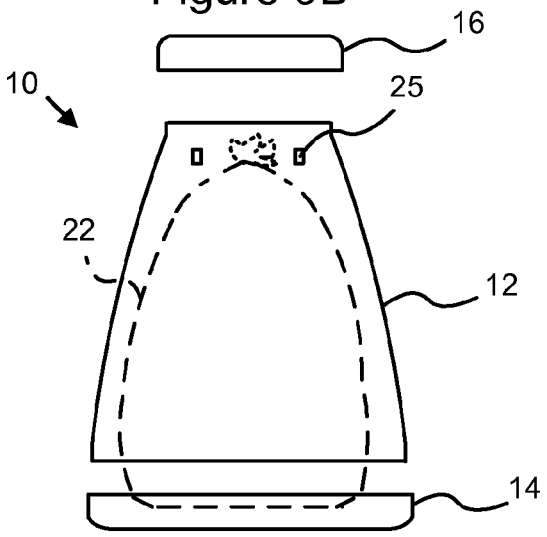

FIGS. 9A-9C illustrate a process for removing the liner 22 from the body 12 according to one embodiment of the present invention. Referring specifically to FIG. 9A, the liner 22 is positioned inside the trash can 10 with the liner 22 extending from the top opening 18, wrapped around the top lip 23, and secured to the body with clips 25.

Referring now to FIGS. 9B and 9C, the user removes the lid 16 and pulls the body 12 from the base 14. Due to the inverted shape of the body 12, a slight vertical movement of the body 12 from the base 14 substantially frees the liner 22 from contacting the entire inner surface of the body 12. Advantageously, the liner 22 becomes substantially disengaged from the body 12 with very little effort by the user, which decreases frictional forces and negative pressure forces common with standard trash cans. Specifically, with standard trash cans the user is required to pull the entire trash bag from the trash can. Accordingly, the trash bag rubs against the trash can the entire length of the trash can. Additionally, the negative pressure in a void behind the trash bag makes removal difficult.

Figure 10A:
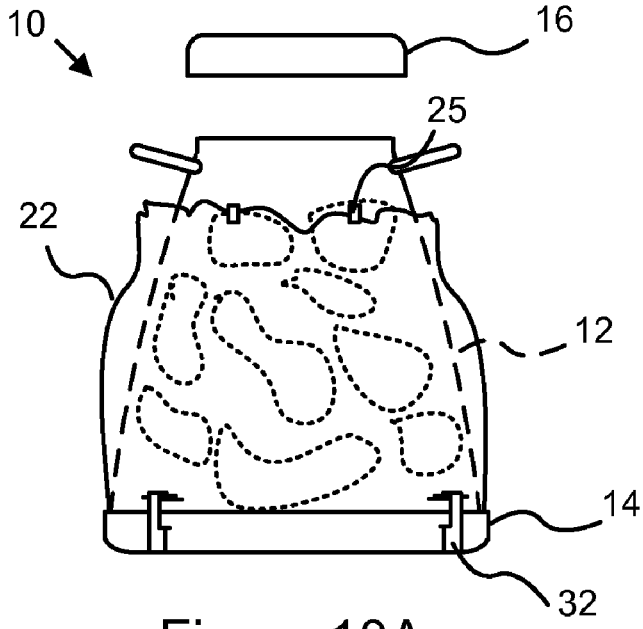
FIGS. 10A-10B illustrate a method of using a body of the apparatus to protect the liner according to one embodiment of the present invention.
Figure 10B:
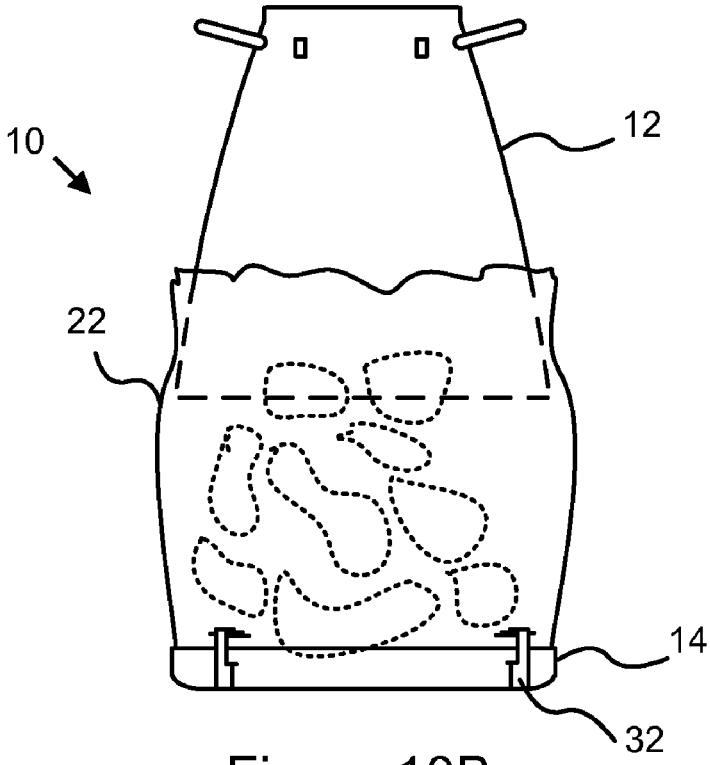

FIGS. 10A-10B illustrate a method of using the apparatus 10 to support and protect the liner 22 when filling the liner 22 with objects that may cause damage to the liner 22 according to one embodiment of the present invention. The body 12 is placed inside the liner 22 and the liner 22 is slightly pulled over the bottom opening 20 of the body 12. The user attaches the base 14 to the body 12. Preferably, the securing means 32 hold the liner 22 below the handles to allow the user to carry the apparatus 10 without risk of grabbing the liner 22 and possibly causing tears or punctures.

The user fills the body 12 with the intended objects, and when full, releases the securing devices 32 to disengage the base 14 therefrom. With the base 14 removed, the objects inside the body 12 drop and pull the liner 22 from the body 12, thus transferring the objects from the body 12 to the liner 22. Preferably, clips 25 hold upper portions of the liner 22 until the user disengages the upper portions therefrom. The body 12 protects the liner 22 until the body 12 is removed.

Figure 11:
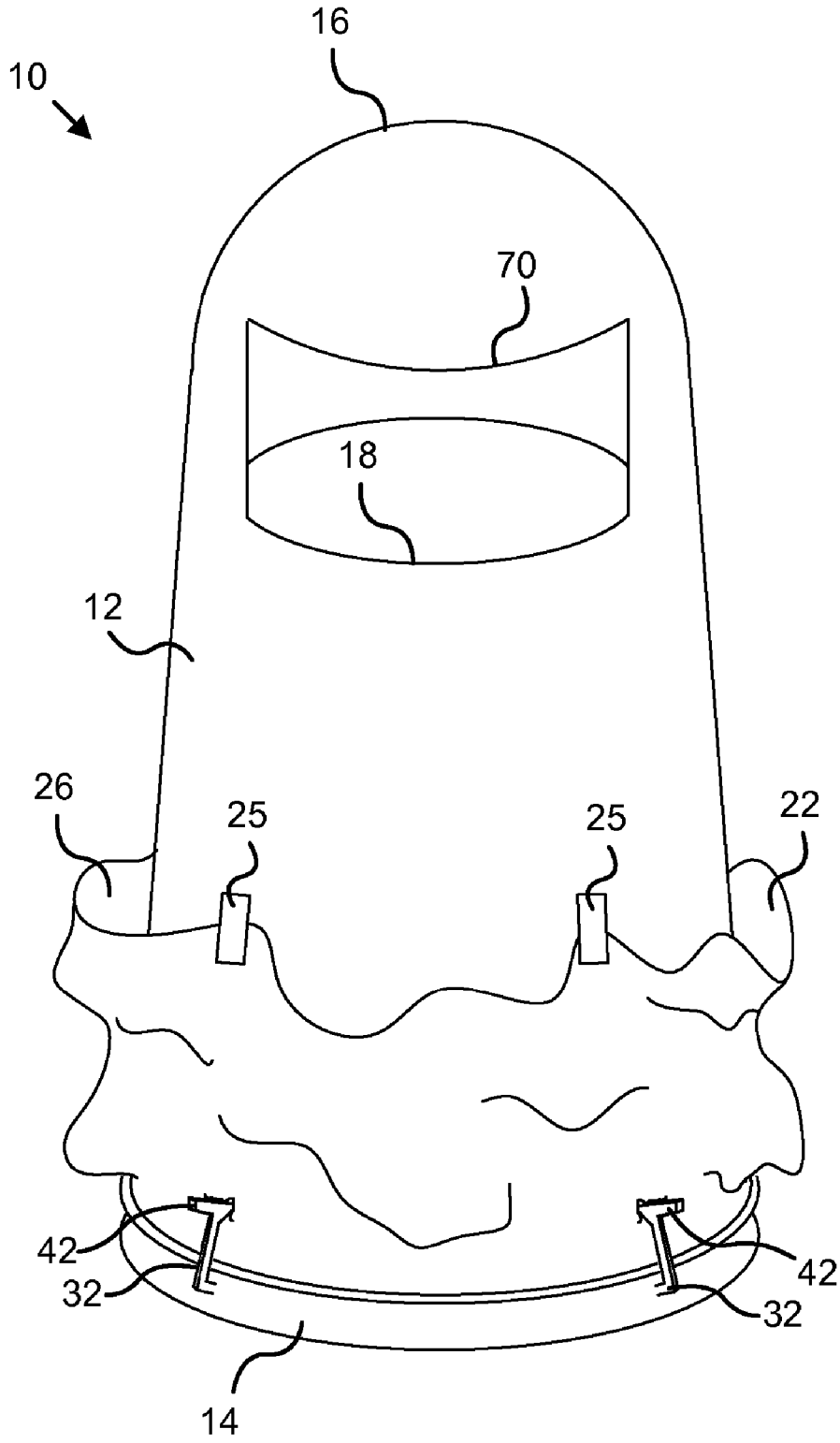
FIG. 11 is a perspective view of an apparatus for supporting a liner with a lid integral to the body according to one embodiment of the present invention.

FIG. 11 illustrates one embodiment of an apparatus 10 with an integrated lid 16. The body 12 may be inserted into the liner 22 as described above with respect to FIGS. 10A-10B. The integrated lid 16 may provide a covering for the contents of the body 12 and may facilitate removing the body 12 from the liner 22. The base 14 may provide support to the liner 22. In certain embodiments, an opening 70 is formed for receiving objects into the top opening 18 of the body 12. The opening 70 may be covered with a hinged door or the like as is known in the art.

Figure 12A:
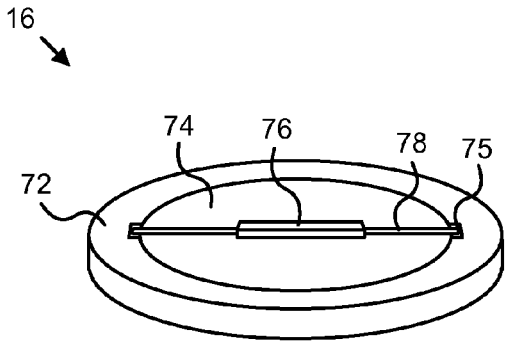
FIGS. 12A-12B are perspective views illustrating a lid having an aperture and a revolving cover according to one embodiment of the present invention.
Figure 12B:
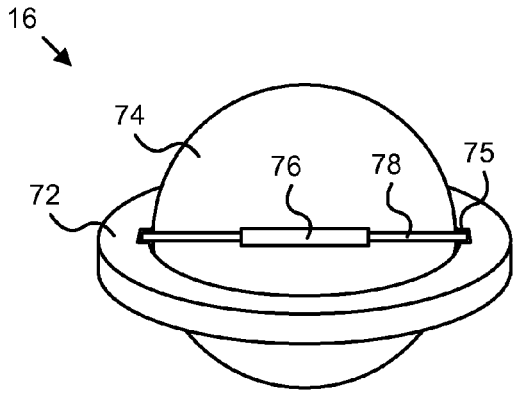
Figure 12C:
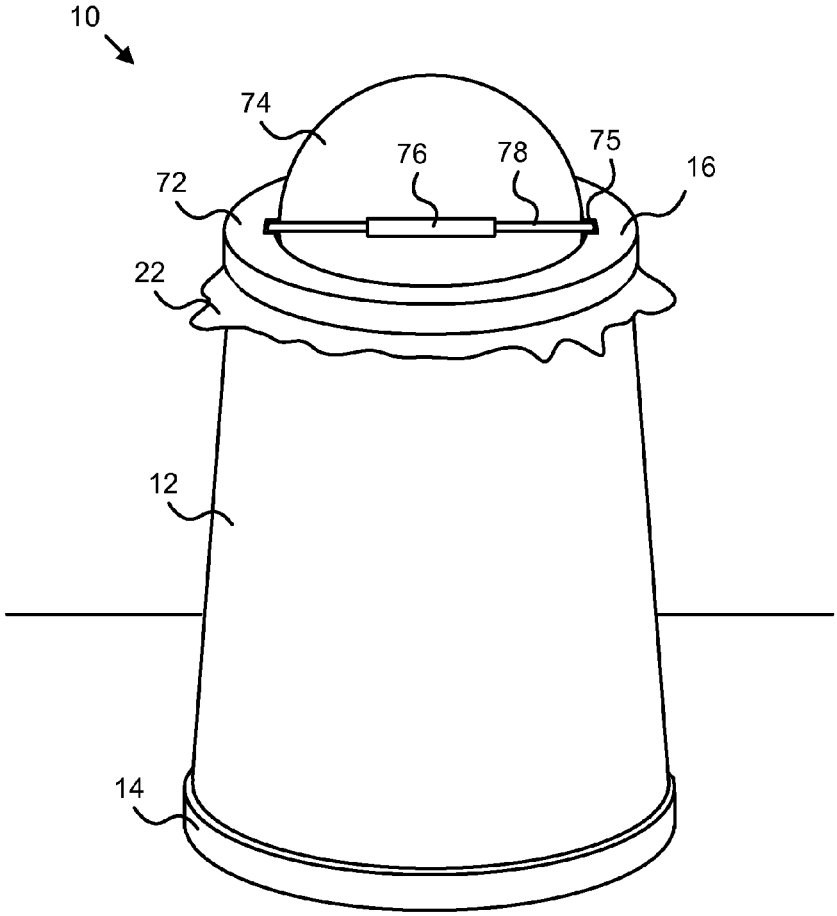
FIG. 12C is a perspective view illustrating an apparatus for supporting a liner covered with the lid of FIGS. 12A-12B according to one embodiment of the present invention.

FIGS. 12A-12B illustrate one embodiment of a suitable lid 16. In the depicted embodiment, the lid 16 comprises an exterior ring 72 and an interior disc 74. The disc 74 is provided with a receiving bracket 76 through which is passed a rod 78. The rod 78 is contained within snap fitted slots 75 within the exterior ring 72 at either end thereof. The receiving bracket 76 and the snap fitted slots 75 allow the rod 78 to swivel so that the disk 74 may be rotated around the rod 78, thereby exposing the top opening 18.

Figure 13A:
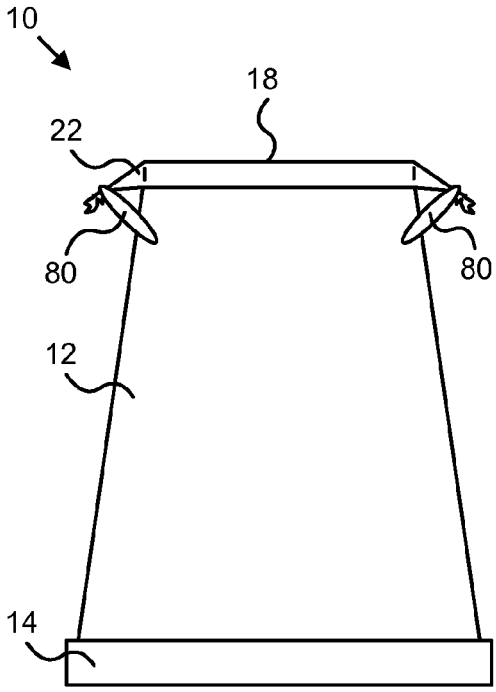
FIG. 13A is a side view illustrating an apparatus for supporting a liner with handles configured to grip the liner according to one embodiment of the present invention.
Figure 13B:
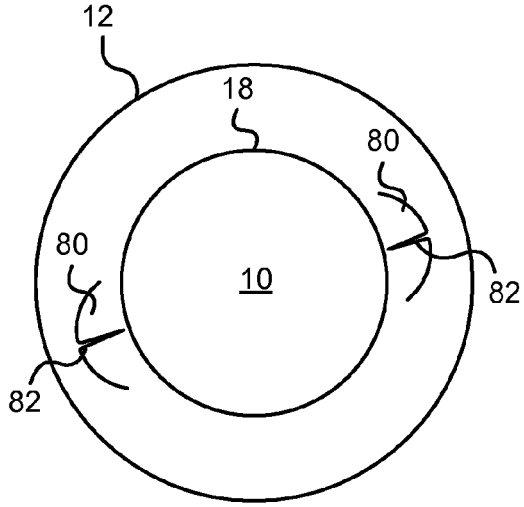
FIG. 13B is a plan view illustrating an apparatus for supporting a liner with handles configured to grip the liner according to one embodiment of the present invention.

FIGS. 13A-13G illustrate certain embodiments of handles 80 that form the dual function of allowing for gripping and transit of the trash can 10 and securing of the liner 22. As shown in FIG. 13B, one or more handles 80 may be connected to the body 10 and in certain embodiments the handles 80 are provided with one or more slots 82. The slots 82 are configured to secure the liner 22 therein. That is, the liner 22 is stretched, and portions of the liner are pulled tight into the slots 82, where the portions are retained once the pressure on the portions is released. Of course, the handles may be used without the slots, and the slots may be formed on brackets that do not function as handles.

Figure 13C:
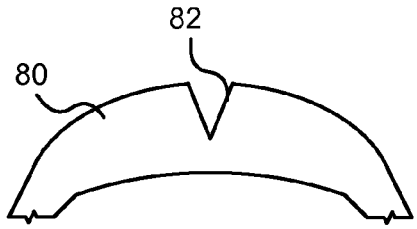
FIGS. 13C-13G are plan views illustrating handles configured to grip the liner according to various embodiments of the present invention.
Figure 13D:
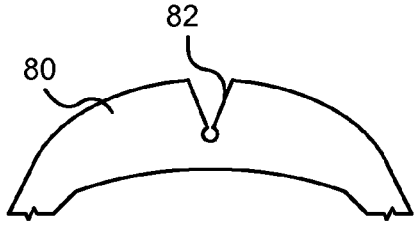
Figure 13E:
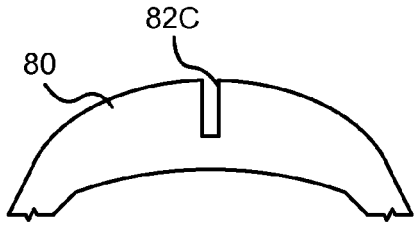
Figure 13F:
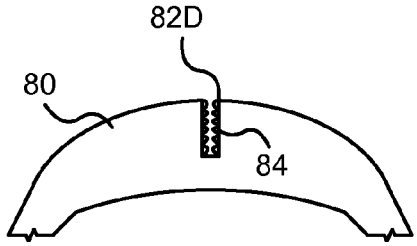
Figure 13G:
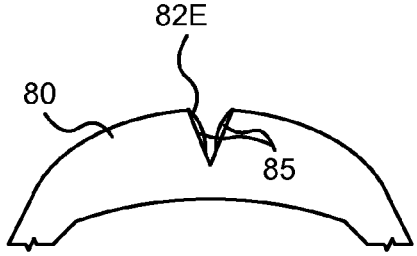

FIGS. 13C-13G show alternate embodiments of the slots 82. FIG. 13C shows the slot in the form of a V, having two sides joining together at the center thereof. FIG. 13D shows the slot 82 in the form of a V having an opening at a juncture of the two sides of the V. FIG. 13E shows the slot having a rectangular shape with two adjoining sides and a central connecting portion. FIG. 13F shows the slot 82D formed substantially similar to the slot 82C of FIG. 13E, and also having formed on the sides of the slot teeth 84. FIG. 13G shows a V-shaped slot 82E having formed thereon sharpened protruding lips 85.

Figure 14:
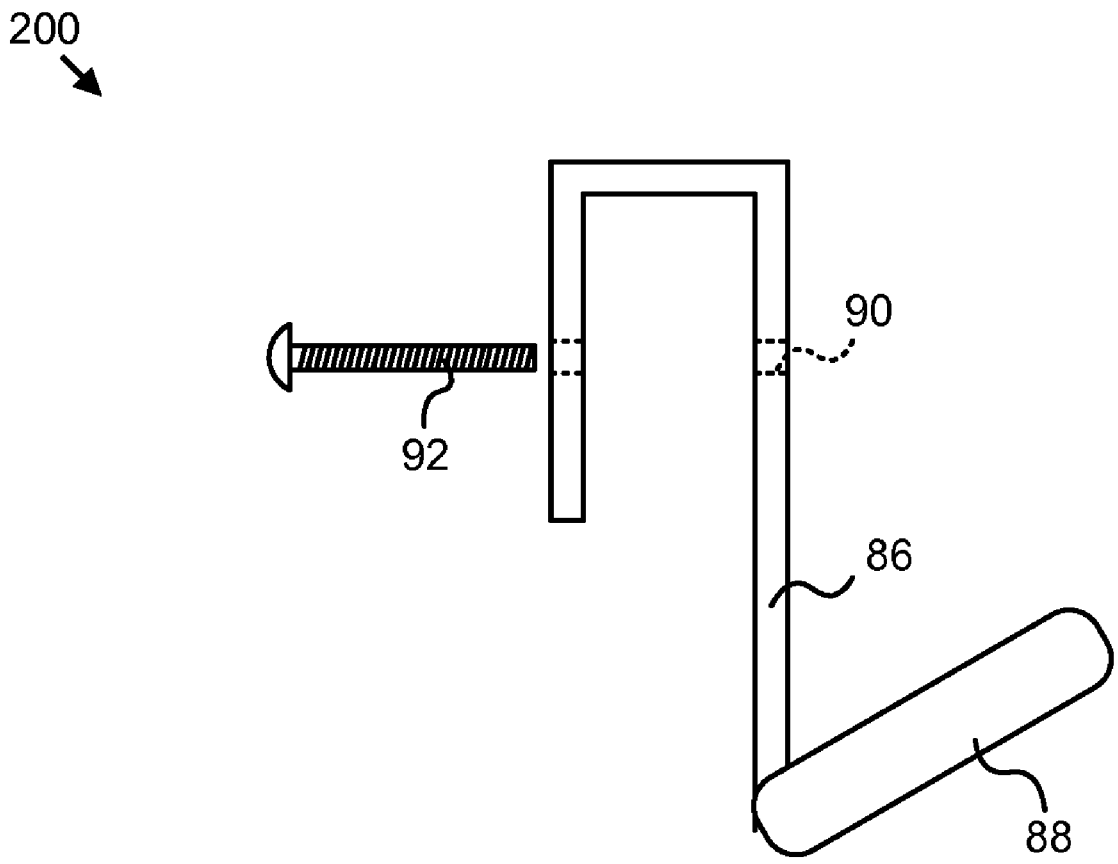
FIG. 14 is a side view illustrating an attachable handle configured to grip the liner according to one embodiment of the present invention.

FIG. 14 shows a handle 200 which may be attached to a new trash can 10 or retrofitted to an existing trash can 10. The handle 200 is formed with a frame portion 86 that may be any suitable shape including flat. In the depicted embodiment, the frame portion 86 is hook shaped in order to be insertable onto a body 12 through the top opening 18 with one end extending inside the opening 18 and one side outside the opening 18. An aperture 90 may be provided to receive a bolt 92. The passageway 90 may be threaded, though a nut (not depicted) may also be used to secure the bolt 92 in place. A grip 88 may be connected with the frame portion 86 to allow a user to grasp the handle 200.

In one embodiment, the handle 200 may be provided with a slot 82 in order to secure a liner 22 therein. The slot 82 may be configured in the same manner as one of the embodiments of FIGS. 13A 13G.

FIGS. 15 and 16 show additional shapes in which the body 12 may be formed. In FIG. 15, the body 12 is formed with steps 95. The steps may also be rounded or ribbed or the like. In FIG. 16, the body 12 is bowed outward. In FIG. 15 and FIG. 16, the body 12 becomes progressively thinner as it progresses upward.

Figure 17A:
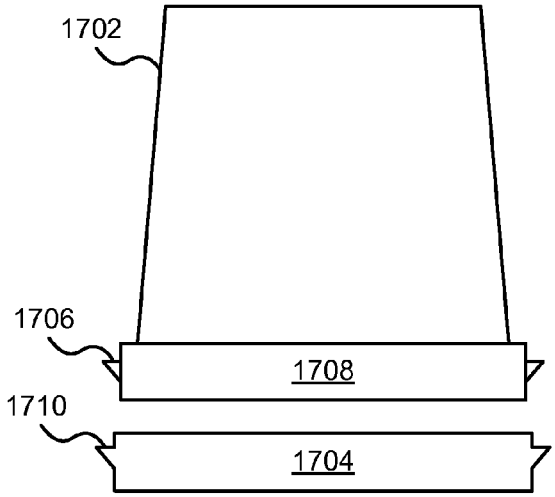
FIGS. 17A-17C illustrate a cross section view of one embodiment of an apparatus for supporting a liner having a compliant latch for a base.
Figure 17B:
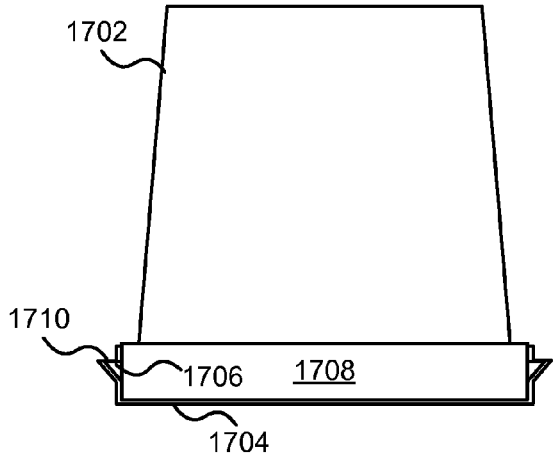
Figure 17C:
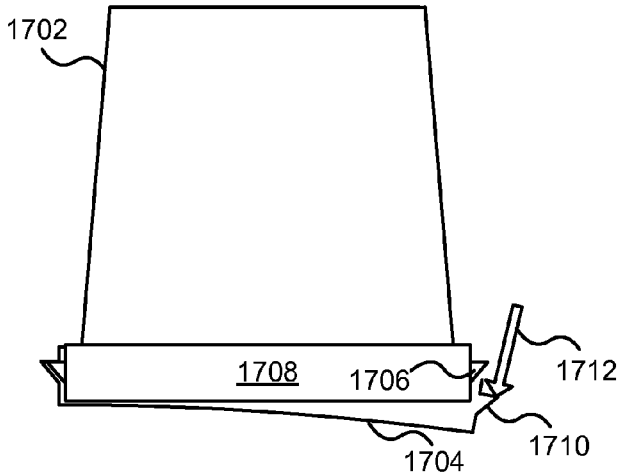

FIGS. 17A-17C illustrate one embodiment of an apparatus to support a liner according to the present invention. The apparatus includes a body 1702, a base 1704, a retention flange 1706, and a compliant latch 1710. The apparatus to support a liner supports a liner with a removable base 1704 that latches to a body 1702 using a compliant latch 1710.

In one embodiment, the body 1702 receives and protects a liner. The body 1702 may include a mating surface 1708 at the bottom opening of the body 1702. In one embodiment, the mating surface 1708 is configured to mate with the base 1704.

The body 1702 further comprises a retention flange 1706 in certain embodiments. The retention flange 1706 may be disposed on the body 1702 near the bottom opening of the body 1702 and be configured to mate with an element of the base 1704 to removably attach the body 1702 to the base 1704. In certain embodiments, the retention flange 1706 may be a separate element attached to the body 1702. In another embodiment, the retention flange 1706 may be formed with the body 1702. For example, the body 1702 and the retention flange 1706 may be injection molded simultaneously.

The base 1704, in certain embodiments, forms a bottom surface of the apparatus. In one embodiment, the base 1704 supports the liner. In a further embodiment, the base further comprises a compliant latch 1710. The compliant latch 1710 interacts with the retention flange 1706 to secure the base 1704 to the body 1702 as illustrated in FIG. 17B.

The compliant latch 1710, in certain embodiments, is a separate element attached to the base 1704. In another embodiment, the compliant latch 1710 is formed with the base 1704. For example, the compliant latch 1710 and the base 1704 may cast in a single mold at the same time.

In certain embodiments, the compliant latch 1710 is configured to flex or deform under a force 1712 to release or engage the compliant latch 1710 from or with the retention flange 1706 as illustrated in FIG. 17C. For example, the base 1704 may be configured to flex when a force 1712 is applied at the compliant latch 1710. As the base 1704 flexes, the compliant latch 1710 disengages from the retention flange 1706 in this example.

As will be appreciated by one skilled in the art, other configurations of compliant latch 1710 may be employed and should be considered within the scope of the present invention. For example, in one embodiment, the compliant latch may be connected to the body 1702 and the retention flange may be connected to the base 1704. In this example, the body 1702 may be configured to flex under a force to free the compliant latch from the retention flange.

In certain embodiments, the compliant latch 1710 acts as a footrest protruding outward from the base 1704. A user may place a foot on the foot rest as the base 1704 is removed from the body 1702. Beneficially, the foot rest allows the user to remove the base from the body without bending to reach the base 1704 by hand.

FIGS. 18A-18D illustrate embodiments of an apparatus to support a liner having a water proof seal according to the present invention. The apparatus may include a body 1702 having a retention flange 1706 and a mating surface 1708, a base 1804, a compliant latch 1804. In certain embodiments, the apparatus includes an O ring 1806. In another embodiment, the apparatus includes a gasket 1808. The apparatus to support a liner having a water proof seal supports and protects a liner while retaining liquid within the apparatus.

The body 1702, the retaining flange 1706 and the mating surface 1708 are preferably configured in a similar manner to like numbered elements described in relation to FIGS. 17A-17C. The compliant latch 1804 is preferably configured in a like manner to the compliant latch 1710 described in relation to FIGS. 17A-17C.

The base 1802, in one embodiment, removably attaches to the body 1702. In certain embodiments, the apparatus includes a substantially waterproof seal at the connection between the base 1802 and the body 1702. Beneficially, the substantially waterproof seal prevents or restricts the escape of liquids when the apparatus receives liquids that escape from the liner, thus preventing leakage.

In certain embodiments, the waterproof seal comprises an O ring 1806. The O ring 1806 may extend around the perimeter of the base 1802 and interact with the base 1802 and the mating surface 1708 to form a substantially waterproof seal. The O ring 1806 may be position in a receiver 1808 formed in the base to retain the O ring 1806 in a functional position. The O ring 1806 may comprise any material known in the art to form a seal, such as an elastomer, nylon, rubber, synthetic rubber, or the like.

Other embodiments of O ring may be employed as will be recognized by one skilled in the art. For example, in an alternate embodiment, the O ring 1806 may be disposed on the body 1702 and interact with the base 1802 upon attachment of the base 1802 to the body 1702. The body 1702 may further include a receiver formed in the body 1702 to hold the O ring 1806 in a functional position. In another example, the O ring 1806 may be independent of the base 1802 and the body 1702.

Figure 18A:
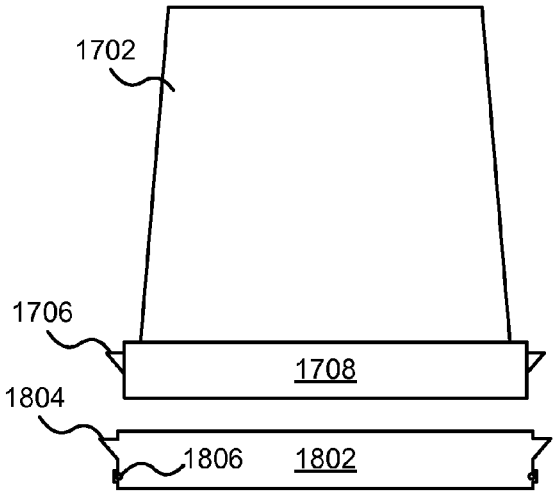
FIGS. 18A-18D illustrate cross section views of embodiments of an apparatus for supporting a liner having a waterproof seal.
Figure 18B:
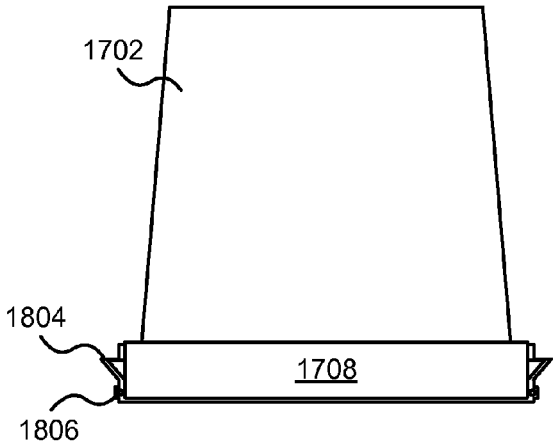
Figure 18C:
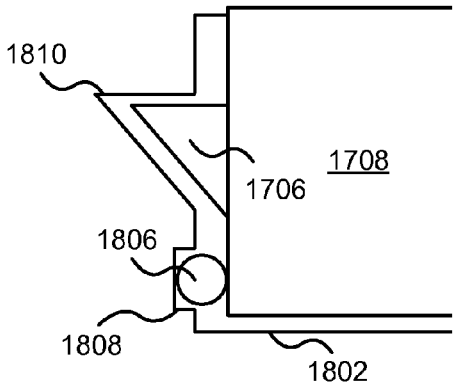
Figure 18D:
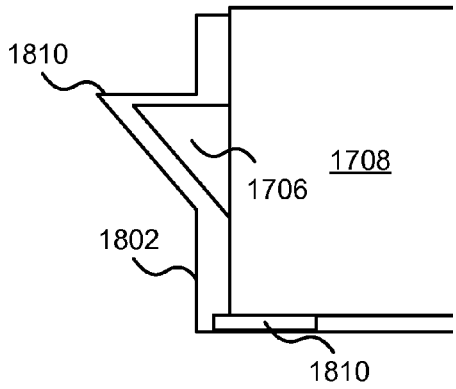

In another embodiment, the waterproof seal comprises a gasket 1810. The gasket 1810. The gasket 1810 may comprise any type of gasket known in the art. For example, in one embodiment, the gasket 1810 may comprise a ring shaped piece of elastomer disposed on an upper surface of the base 1802 and configured to mate with a bottom surface of the body 1702 as illustrated in FIG. 18D.

FIGS. 19A-19D illustrate embodiments of an apparatus to support a liner having a lid 1904 that fastens to the body 1902 using a compliant latch 1910. The apparatus may include a body 1902 having an upper retention flange 1906 and an upper mating surface 1908, a lid 1904, a compliant latch 1910 and a waterproof seal 1912. In certain embodiments, the apparatus further includes a base 1802 that attaches to the body 1902 using a compliant latch 1804 as described in FIGS. 17A-17C and 18A-18D. The apparatus with the attachable lid 1904 provides a secure means for closing the apparatus and for using the apparatus with either the top opening or the bottom opening facing up.

The body 1902 in certain embodiments, includes an upper retention flange 1906 and an upper mating surface 1908. The upper retention flange 1906 and the upper mating surface 1908 may interface with a lid 1904 to provide a closure for the top opening of the body 1902. The body 1902 may have other characteristics as described in relation to FIGS. 1-18.

Figure 19A:
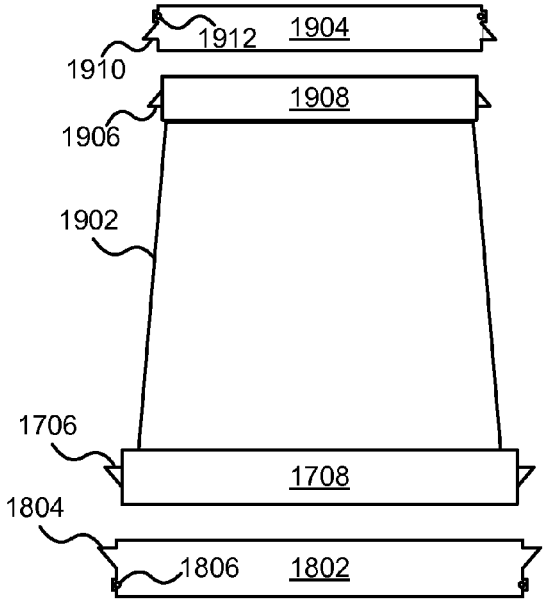
FIGS. 19A-19D illustrate cross section views of embodiments of an apparatus for supporting a liner having a compliant latch for a lid.
Figure 19B:
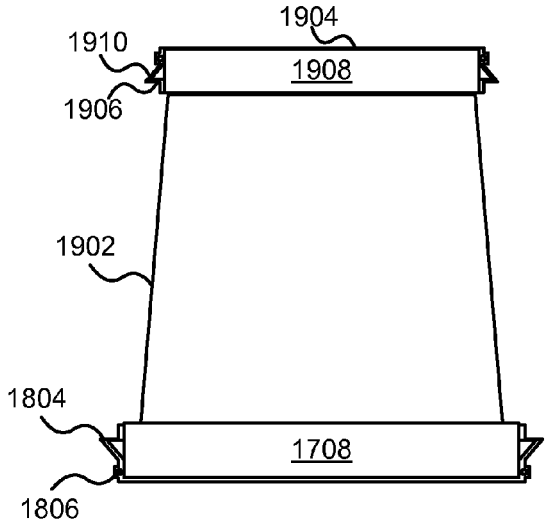
Figure 19C:
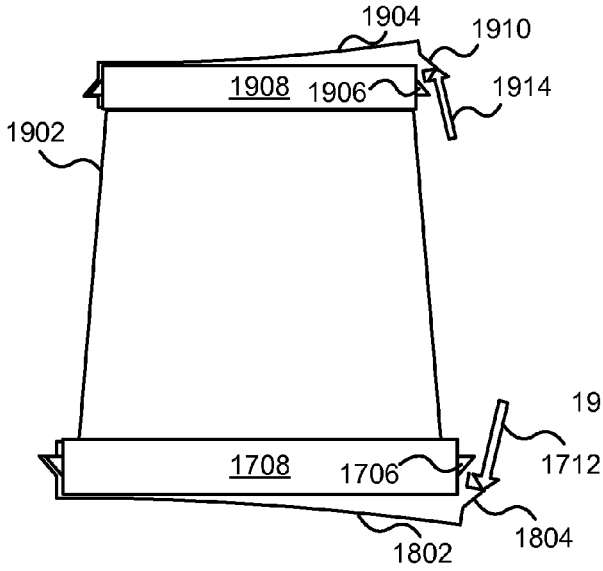
Figure 19D:
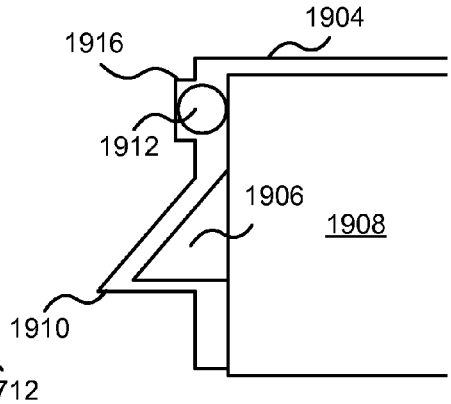

The lid 1904, in certain embodiments, is configured in a manner similar to the base 1704, 1802 described in previous figures. The lid 1904 may have an upper compliant latch 1910 that mates with an upper retention flange 1906 of the body 1902. In certain embodiments, the upper compliant latch 1910 disengages from the upper retention flange 1906 under a force 1914 as shown in FIG. 19C. The force may cause a component of the apparatus to flex or deform, allowing the upper compliant latch 1910 to disengage and the lid 1904 to be removed from the body 1902. In one embodiment, the lid 1904 is flexible, and the lid 1904 deforms under the applied force 1914.

In one embodiment, the lid 1904 includes a waterproof seal 1912. The waterproof seal 1912 restricts the flow of liquid. Beneficially, the waterproof seal 1912 allows the apparatus to contain a liquid when positioned with the top end of the body 1902 facing down.

The waterproof seal 1912 may comprise any type of seal known in the art, including an O ring, a gasket, and the like. The waterproof seal 1912 may be attached to the lid 1904, the base 1902, both the lid 1904 and the base 1902, or neither the lid 1904 or the base 1902. In certain embodiments, the waterproof seal 1912 includes a receiver 1916 to position the waterproof seal 1912 in a functional position.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to releasably support a liner, the apparatus comprising:

a body having a top opening and a bottom opening, the area of the top opening being less than the area of the bottom opening, the body configured to receive a liner, wherein the liner is longer in length than the body;

a base, comprising an inner surface of the base configured to provide support to a bottom of the liner;

wherein the base is releasably attachable to the body at the bottom opening of the body using a compliant latch, the compliant latch disposed on one of the base and the body and configured to interlock with a retention flange, the retention flange disposed on another of the base and the body;

wherein the compliant latch forms a foot rest protruding outward from the base and formed of a flexible material configured to deform the base under a force such that the compliant latch disengages from the retention flange; and a lid releasably attachable to the body at the top opening, such that the body may be accessed at the top or the bottom.

2. The apparatus of claim 1, further comprising a handle attached to the body.

3. The apparatus of claim 1, further comprising clips attached to an outer surface of the body, configured to secure upper edges of the liner to the body.

4. The apparatus of claim 1, wherein the body angles inward on the outside surface, from the bottom opening to the top opening, at more than 90 degrees, with respect to the base.

5. The apparatus of claim 1, wherein the body attaches to the base with a substantially water proof seal.

6. The apparatus of claim 5, wherein the substantially water proof seal comprises a gasket disposed between the base and the body.

7. The apparatus of claim 5, wherein the substantially water proof seal comprises an O ring disposed between the base and the body.

8. The apparatus of claim 1, wherein the body attaches to the lid with a substantially water proof seal.

9. The apparatus of claim 8, wherein the substantially water proof seal comprises a gasket disposed between the lid and the body.

10. The apparatus of claim 5, wherein the substantially water proof seal comprises an O ring disposed between the lid and the body.

11. The apparatus of claim 1, wherein the body comprises a releasable substantially vertical seam for providing access to an interior of body.

12. The apparatus of claim 1, further comprising clips disposed on the exterior of the body for receiving the liner when the liner extends out of the bottom opening.

13. The apparatus of claim 1 wherein the lid is releasably attachable to the body at the top opening of the body using a compliant latch, the compliant latch disposed on one of the lid and the body and configured to interlock with a retention flange, the retention flange disposed on another of the lid and the body.

14. An apparatus to protect and support a liner, comprising:

a body having a top opening and a bottom opening, the area of the top opening being less than the area of the bottom opening, the body configured to be inserted into a liner;

a base comprising an inner surface of the base configured to provide support to a bottom of the liner;

wherein the base is releaseably attached to the body at the bottom opening of the body using a compliant latch, the compliant latch disposed on the base and configured to interlock with a retention flange, the retention flange disposed on the body;

wherein the compliant latch forms a foot rest protruding outward from the base and formed of a flexible material configured to deform the base under a force such that the compliant latch disengages from the retention flange;

an O ring disposed between the base and the body, the O ring configured to seal the apparatus to prevent the passage of liquid from the body; and a lid at the top of the body to cover the top opening, such that body may be accessed at the top or the bottom.

15. The apparatus of claim 14, wherein the apparatus further comprises handles attached to the body, and wherein the handles remain accessible even with the liner attached to the body.

16. The apparatus of claim 15, further comprising a notch formed in each of the handles to secure the liner.

17. The apparatus of claim 14, wherein the base and the lid are both securely fastenable such that the apparatus may be used with either the top opening or the bottom opening facing up to receive objects.

18. The apparatus of claim 14, further comprising wheels attached to the base.

19. A method for using an apparatus to support and protect a liner, the method comprising:

providing a body with a top opening and a bottom opening;

inserting the body into an opening of the liner;

gathering the opening of the liner and sides of the liner about the body;

attaching a base to the bottom opening with a compliant latch, the compliant latch forming a foot rest disposed on the base and configured to interlock with a retention flange, the retention flange disposed on the body;

securing the liner and sides of the liner to a lower portion of the body;

filling the body with objects;

removing the base by applying a force to the foot rest and allowing the objects to move from the body to the liner; and removing the body from inside of the liner.

20. The method of claim 19, further comprising providing a handle formed on the body, the handle having a notch formed therein and securing the liner within the notch.

21. The method of claim 19, wherein inserting the body into an opening of the liner comprises one of inserting the body into the opening of the liner with the top opening facing up to receive objects and inserting the body into the opening of the liner with the bottom opening up to receive objects.

* * * * *